US012492828B2

(12) United States Patent
Fulda

(10) Patent No.: US 12,492,828 B2
(45) Date of Patent: Dec. 9, 2025

(54) COMPACT, LEAKLESS, AND POWER-EFFICIENT PACKAGED TERMINAL AIR CONDITIONER (PTAC) WITH AN EVAPORATING ELEMENT FOR THE MELTWATER

(71) Applicant: Yehuda Fulda, Beit Shemesh (IL)

(72) Inventor: Yehuda Fulda, Beit Shemesh (IL)

( * ) Notice: Subject to any disclaimer, the term of this patent is extended or adjusted under 35 U.S.C. 154(b) by 65 days.

(21) Appl. No.: 18/204,578

(22) Filed: Jun. 1, 2023

(65) Prior Publication Data

US 2023/0324053 A1 Oct. 12, 2023

Related U.S. Application Data

(60) Provisional application No. 63/349,154, filed on Jun. 6, 2022.

(51) Int. Cl.

| | |
|---|---|
| ***F24F 1/035*** | (2019.01) |
| ***F24F 1/027*** | (2019.01) |
| ***F24F 1/0314*** | (2019.01) |
| ***F24F 1/0323*** | (2019.01) |

(52) U.S. Cl.

CPC ..... *F24F 1/0323* (2019.02); *F24F 1/027* (2013.01); *F24F 1/0314* (2019.02); *F24F 1/035* (2019.02); *F24F 2221/17* (2013.01)

(58) Field of Classification Search

CPC ..... F24F 1/0323; F24F 1/0314; F24F 1/035; F24F 12/006; F24F 1/027; F24F 2221/17

See application file for complete search history.

(56) References Cited

U.S. PATENT DOCUMENTS

| | | | | |
|---|---|---|---|---|
| 2020/0278128 | A1* | 9/2020 | Patel | F24F 1/037 |
| 2021/0199315 | A1* | 7/2021 | Chen | F24F 1/022 |
| 2023/0304692 | A1* | 9/2023 | Yu | F24F 11/79 |

* cited by examiner

*Primary Examiner* — Frantz F Jules
*Assistant Examiner* — Martha Tadesse

(57) ABSTRACT

The present invention discloses a novel packaged terminal air conditioner (PTAC) system that is compact, leakless, and power-efficient and integrates an evaporating element that heats and evaporates the meltwater collected within a drain pan disposed of in the outdoor portion. The proposed PTAC system includes an air sealing frame configurable within the sleeve of the PTAC system to completely seal off air infiltration from the sidewalls of the sleeve. The air sealing frame configurable within the sleeve further provides sufficient insulation and prevents any thermal bridge creation and also insulates the sound that usually gets transmitted from the outdoor portion to the indoor portion of the PTAC system or sound that's experienced in the room. The proposed PTAC has a decreased protruding length of the indoor portion within the interior of the room due to the presence of the air sealing frame.

20 Claims, 16 Drawing Sheets

COMPACT, LEAKLESS, AND POWER-EFFICIENT PACKAGED TERMINAL AIR CONDITIONER (PTAC) WITH AN EVAPORATING ELEMENT FOR THE MELTWATER

CROSS-REFERENCE TO RELATED PATENT DOCUMENTS

This patent application claims the benefit of priority of U.S. Provisional Application No. 63/349,154 entitled "COMPACT, LEAKLESS, AND POWER-EFFICIENT PACKAGED TERMINAL AIR CONDITIONER (PTAC) WITH AN EVAPORATING ELEMENT FOR THE MELTWATER," filed 6 Jun. 2022, which is hereby incorporated herein by reference in its entirety.

TECHNICAL FIELD

This invention relates generally to the field of air conditioner systems, and more particularly to a more compact, leakless, and power-efficient packaged terminal air conditioner (PTAC) system with an evaporating element that heats and evaporates the meltwater collected within a drain pan housed within the PTAC system.

BACKGROUND

Typical packaged terminal air conditioning (PTAC) systems such as the one shown in FIGS. 1 and 2A-2D are well-known and widely used in commercial buildings (such as hotels) and residential sites to adjust the temperature indoors. PTAC system 100 is self-contained air conditioning and heat unit designed to heat and cool a limited space. Although PTACs are self-contained, they include both an indoor portion 102 and an outdoor portion 104 separated usually by an intermediate separation wall 105. PTACs often need to draw air from the outdoor portion 104 into the indoor portion 102. PTAC systems are installed on the exterior wall 200 (as seen in FIG. 2A and FIG. 2B) or windows of the building such that the air inlet portion of the system 100 generally projects outward beyond the outer wall of the building and the air venting portions 109*a*,109*b* of the system are positioned inward through the interior wall 202. Generally, the heating and cooling mechanism is housed within a sleeve/housing 106. Particularly, the outdoor portion104 includes elements that are housed within the sleeve 106 and present behind the separation wall 105. The indoor portion 102 includes elements that are present within the interior 202 of the room and projects inwards within the room and is covered by a cover panel 109. PTAC also includes a closed refrigeration loop to heat or cool the indoor air of the living space. Typically, the indoor air is recirculated while being heated or cooled using a typical PTAC system. The compressor/heat pump plays an important role and does most of the work (resulting in more power consumption) of taking in outdoor air and then performing necessary cooling and heating on this drawn air in order to pass on the resultant conditioned air in the room via the air venting portion 109*a*,109*b* of the system 100.

Some of the drawbacks associated with such typical prior art PTAC system 100 that the inventor has observed are as under:

- Air leakage from the sidewalls of the sleeve resulting in infiltration—The outdoor air is drawn within the sleeve 106 and usually leaks from the meeting edge of the interior of the sidewall of the sleeve 106 and the separation wall 105 (as indicated by arrow heads in FIGS. 2B and 2C). Also, the outdoor air tries to pass from the outdoor to the indoor or interior of the room through the crack or opening usually present in between the exterior sidewall of the sleeve 106 and the cut-out section of the wall 200 (as seen in FIGS. 2A and 2B). The leakage of the air is a result of gap formation between the sleeve walls 106 and the separation wall 105 and the cut-out section of wall 200 into which the sleeve or PTAC is usually mounted.
- The separation wall 105 is poorly insulated and is thin in the traditional PTAC system leading to thermal bridge formation.
- The indoor portion 102 in traditional PTAC systems 100 typically protrudes about 8 inches within the interior of the room which usually provides an unpleasant look or decreases the aesthetics of the room.
- Traditional PTAC system with a heat pump/compressor typically consumes more power
- Traditional PTAC systems are noisy

SUMMARY

The present invention has been designed to address the issues discussed above and others with an object to provide a novel configuration for a PTAC system.

The inventor herein proposes a novel configuration for a PTAC that includes an integrated ERV or HRV unit with an exhaust port oriented to redirect the exhausted air (cool or warm air) through a curvy route/channel towards the outdoor coil for increased power efficiency.

Another objective of the present invention is to provide an air sealing frame configurable within the sleeve of the PTAC system to completely seal off the air leakage or air infiltration from the sidewalls of the sleeve.

Another objective of the present invention is to provide an air sealing frame configurable within the sleeve of the PTAC system which is insulated and made thicker to prevent thermal bridge creation between the separation wall of the PTAC and the room, this helps in reducing noise as well that usually gets transmitted from the outdoor (due to fan or compressor) to indoor portion or within the room.

Another objective of the present invention is to provide a novel configuration for the PTAC with a decreased protruding length of the indoor portion within the interior of the room. This is made possible by the air sealing frame which facilitates the mounting of various indoor components within the sleeve up to a certain depth of the sleeve.

Another objective of the present invention is to provide a novel front panel cover design for covering the indoor portion of the PTAC system. The front panel cover has a curvy design and side vents for the air to get into the room.

Another objective of the present invention is to provide a novel configuration for the PTAC system with an air filter housing configured in the form of a bracket. The bracket houses air filters and sits on the ERV core in a slanted or angled orientation so as to allow easy removal of the air filters for cleaning or replacement purpose.

Another object of the present invention is to provide a novel configuration for the PTAC system including a tray for the indoor coil to sit thereon and collect melted water and pass on the collected water to the drain pan provided in the outdoor portion.

Various advantages and features of the present invention are described herein with specificity so as to make the present invention understandable to one of ordinary skill in the art, both with respect to how to practice the present invention and how to make the present invention.

BRIEF DESCRIPTION OF THE DRAWINGS

The above set forth and other features of the present invention are made more apparent in the ensuing description of the preferred embodiments when read in conjunction with the attached drawings, wherein.

DETAILED DESCRIPTION

Figure 1:
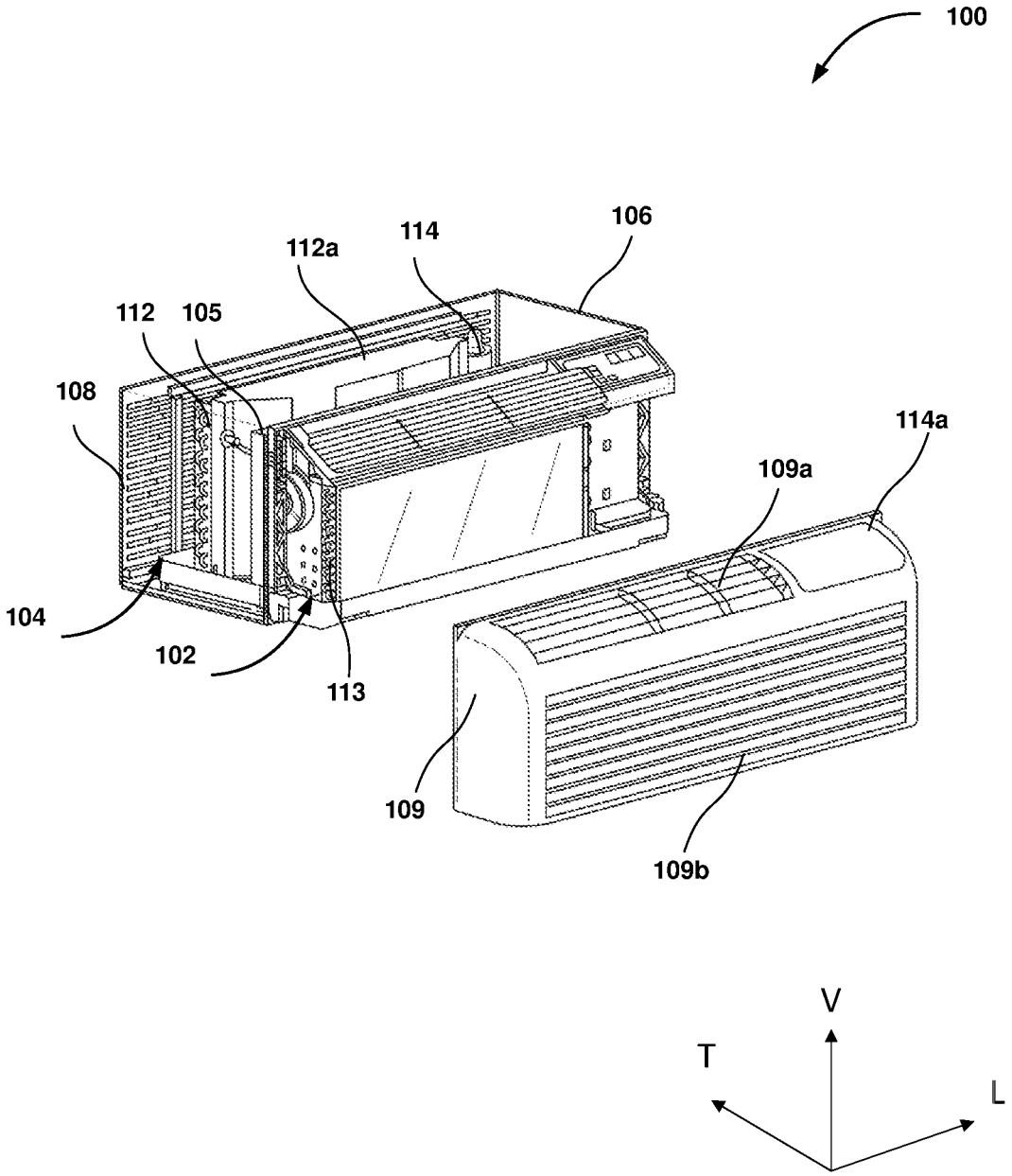
FIG. 1 (Prior Art)
FIG. 1 shows an exploded view of a typical prior art PTAC system.

Certain terminology is used in the following description for reference only and is not limiting. Unless specifically set forth herein, the terms "a," "an," and "the" are not limited to one element, but instead should be read as meaning "at least one." The terminology includes the words noted above, derivatives thereof, and words of similar import. Before describing the present invention in detail, it should be observed that the present invention utilizes a combination of components, which constitutes a novel configuration for a PTAC system. Accordingly, the components have been represented, showing only specific details that are pertinent for an understanding of the present invention so as not to obscure the disclosure with details that may be readily apparent to those with ordinary skill in the art having the benefit of the description herein. As required, the detailed embodiments of the present invention are disclosed herein. However, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

The words "comprising", "having", "containing", and "including", and other forms thereof, are intended to be equivalent in meaning and be open-ended in that an item or items following any one of these words is not meant to be an exhaustive listing of such item or items or meant to be limited to only the listed item or items.

Referring now to FIGS. 1, 2A-2D, a typical traditional packaged terminal air conditioning (PTAC) unit 100 is shown. The PTAC unit 100 includes an indoor portion 102 and an outdoor portion 104 separated by an intermediate wall 105. The indoor portion 102 and the outdoor portion 104 generally define a vertical direction V, a lateral direction L, and a transverse direction T, all oriented perpendicular to each other.

A housing/sleeve 106 of the PTAC 100 may contain various other components, for example, a rear grill 108 as part of the outdoor portion 104, and a front panel/cover 109 as part of the indoor portion 102. The rear grill 108 and the front panel cover 109 are disposed of in spaced-apart relation along the transverse direction T. The rear grill 108 consists of a plurality of uniform openings to allow airflow therethrough.

The components of the outdoor portion 104, such as an outdoor heat exchanger/outdoor coil 112, an outdoor fan (not seen), and a compressor 114 may be housed within the housing/sleeve 106. The outdoor fan is preferably a linear fan that pushes the air out from the outdoor portion 104 to outside in the external environment. The outdoor fan and the outdoor heat exchanger or coil 112 are mounted in a spaced-apart relation long direction T. The compressor 114 is housed towards the lateral direction L with respect to the outdoor fan. Particularly, the compressor 114 and associated fluid lines are housed behind a control panel 114*a* (along direction T). the control panel 114*a* consists of one or more input buttons and display means.

The indoor portion 102 may include, for example, an indoor heat exchanger/indoor coil 113, an indoor fan (not shown), and a heating unit (not shown). These components may be housed behind the front panel cover 109 of the PTAC. The intermediate wall 105 generally defines the indoor portion 102 and outdoor portion 104 and functions to separate them. As shown, in the conventional PTAC unit 100, the outdoor heat exchanger 112 is configured parallel to the indoor heat exchanger 113, and the outdoor fan is located behind and in between the outdoor heat exchanger 112 and the intermediate wall 105. The outdoor fan may be encased inside a casing 112*a*.

The PTAC system 100 also includes a refrigeration loop consisting of the outdoor and indoor heat exchangers 112, 113, the compressor 114, and an expansion device (not shown).

The compressor 114 and expansion device may be in fluid communication with outdoor heat exchanger 112 and indoor heat exchanger 113 for the flow of refrigerant (Eg. R410*a*) therethrough as known in the art. More particularly, the refrigeration loop may include various flow lines to allow the flowing of refrigerant between the various components of the refrigeration loop. Refrigerants can flow through such lines from indoor heat exchanger 113 to the compressor 114, from the compressor 114 to outdoor heat exchanger 112, from the outdoor heat exchanger 112 to the expansion device, and from the expansion device to indoor heat exchanger 113. The refrigerant may generally undergo phase changes associated with a refrigeration cycle as it flows to and through these various components, as is generally known in the art. The refrigeration loop may be operated in a cooling mode or a heating mode using the one or more buttons provided on the control panel 114*a* or using a remote-control device (not shown) provided with the PTAC unit 100, depending upon which the indoor heat exchanger 113 may act as an evaporator and the outdoor heat exchanger 112 acts as a condenser or vice versa. As known in the art, the outdoor and indoor heat exchangers 112, and 113 include coils through which the refrigerant may flow for heat exchange purposes. The compressor 114 as used and preferred may be a variable speed compressor that may be operated at various speeds depending on the air conditioning need of the room and the demand of the refrigeration loop. The compressor 114 plays an important role in cooling or heating the outdoor air before sending it to the room and is operational all the time during the operation of the typical PTAC.

Depending upon the air conditioning command, the PTAC 100 functions to cool or heat the room to the desired level, and the compressor 114 remains operational all the time to meet the air conditioning requirement. The more the air conditioning required, the more the compressor 114 has to work. The more the compressor 114 is performing the work in order to heat or cool the room, the more power it consumes. This leads to being costly especially with ever-increasing utility/electricity charges. Thus, there exists a desire for a solution that would lessen the workload on the compressor and thus decrease the overall power consumption of the PTAC.

Figure 2A:
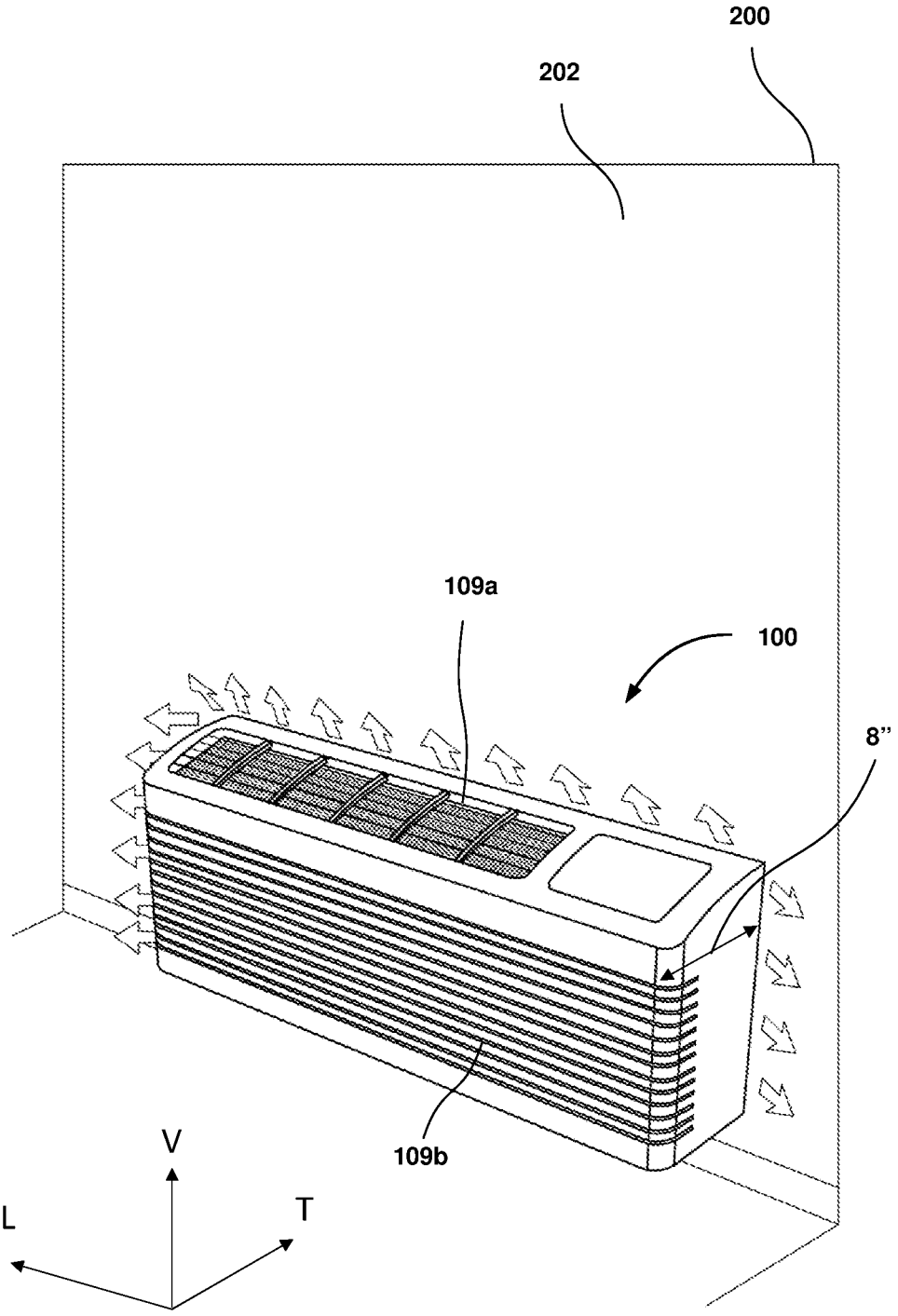
FIG. 2A (Prior Art)
FIGS. 2A and 2B show the PTAC system of FIG. 1 mounted on an external wall.
Figure 2B:
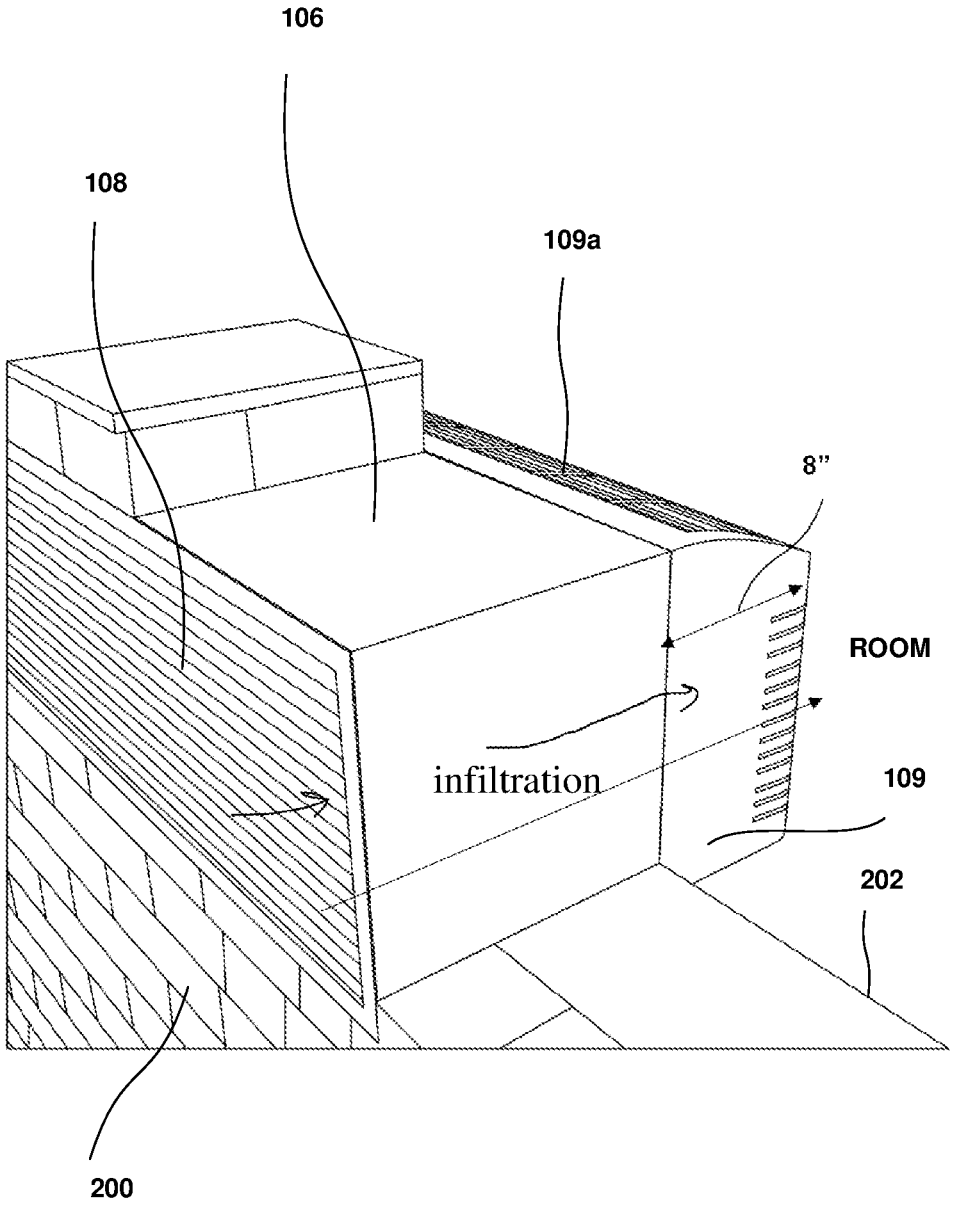
FIG. 2B (Prior Art)
Figure 2C:
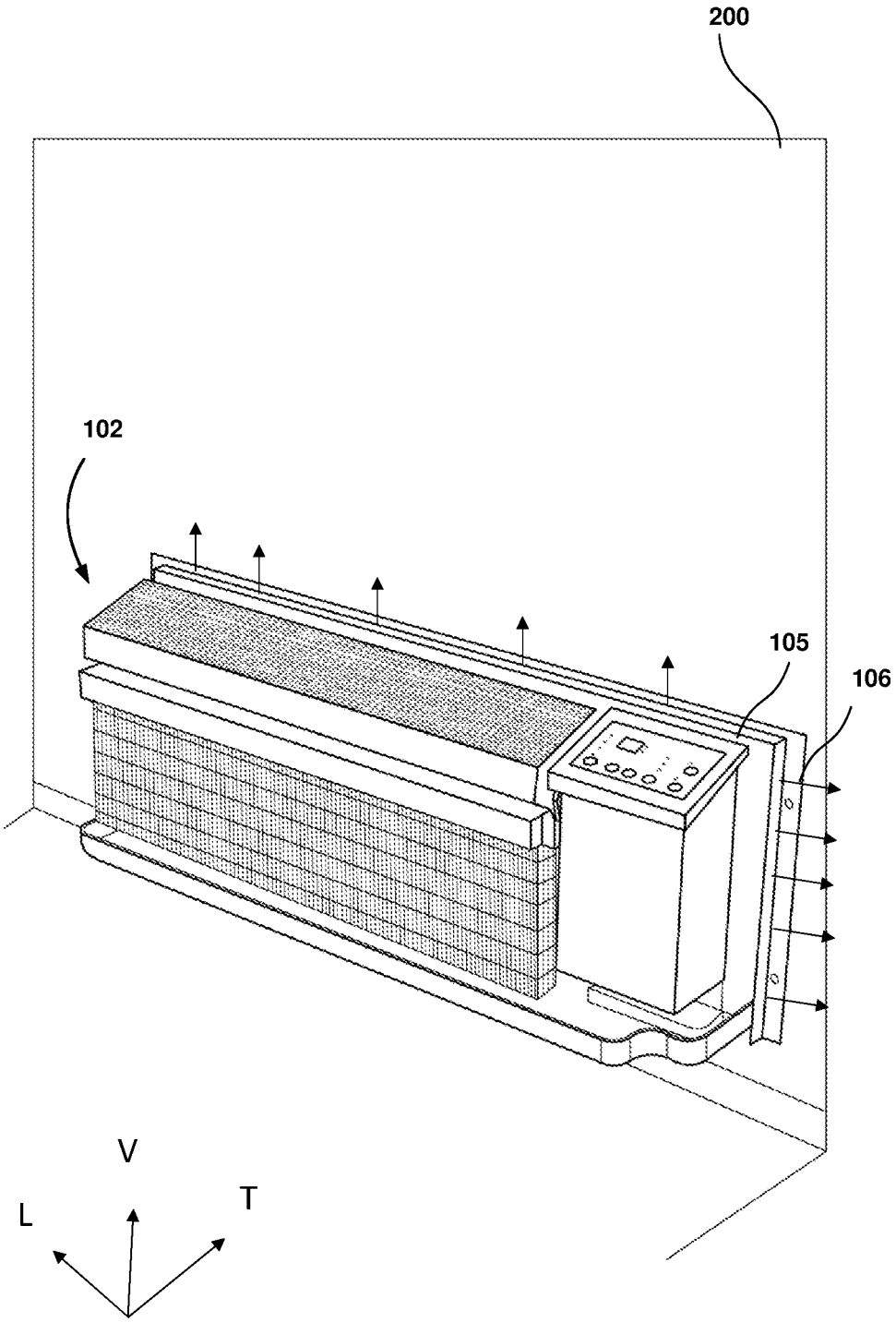
FIG. 2C (Prior Art)
FIG. 2C shows the PTAC system of FIG. 1 mounted on an external wall with a front panel cover removed.
Figure 2D:
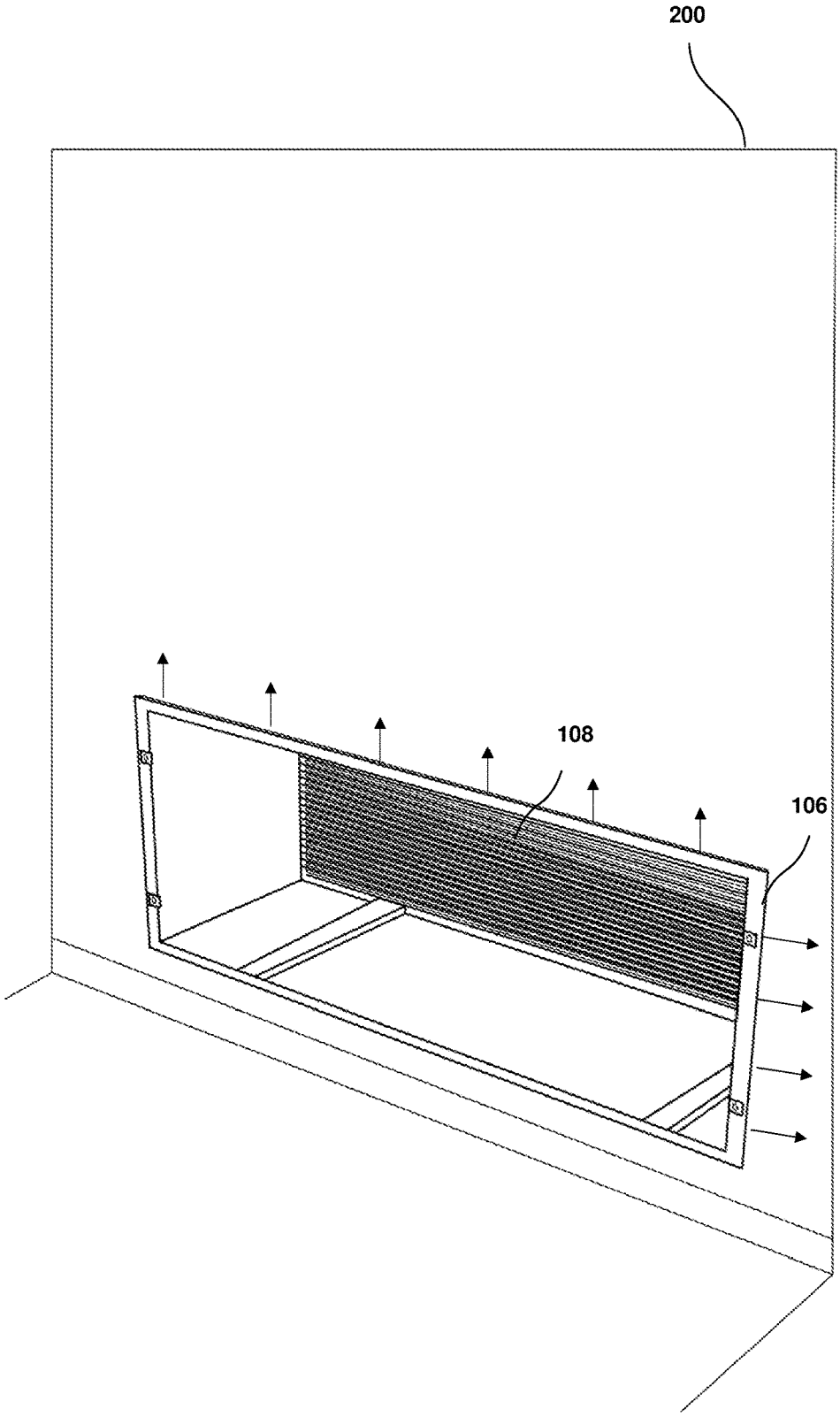
FIG. 2D (Prior Art)
FIG. 2D shows a typical sleeve with a rear grill of the PTAC system of FIG. 1 installed on an external wall with all other indoor and outdoor components removed.

Further, sealing between the separation wall 105 and the interior sidewall of the sleeve 106 is very poor in the traditional PTAC system 100 leading to infiltration causing the outdoor air entering the PTAC 100 to leak as shown by arrows in FIG. 2B and FIG. 2C. Additionally, the outdoor air also tries to leak from the gap in between the edges of the cut-out section of the external wall 200 and the external sidewalls of the sleeve 106 as shown in FIGS. 2A and 2B. The leakage is commonly termed "air infiltration".

Not only this but the sound generated at the outdoor portion 104 of the traditional PTAC system 100 is transmitted to the indoor portion due to the poorly insulated barrier or separation wall 105. This causes a lot of inconvenience to the users. Also, due to this poorly insulated barrier (or separation wall), a thermal bridge gets created between the unit and the room.

Also, in the traditional PTAC system 100 as shown in FIGS. 2A-FIG. 2C, the indoor components of the indoor portion 102 (beyond the separation wall 105) protrude to a longer distance occupying more space (about 8 inches) within the interior of the room. This is something unpleasant and undesirable especially when the living space/room is smaller.

Figure 10:
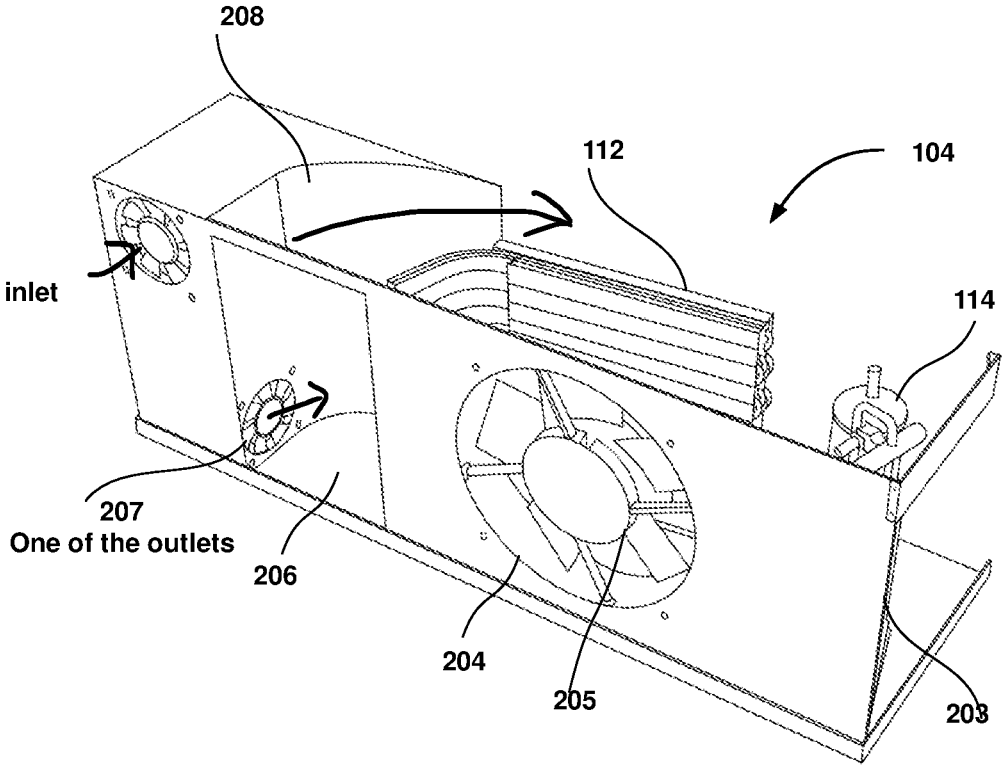
Figure 11A:
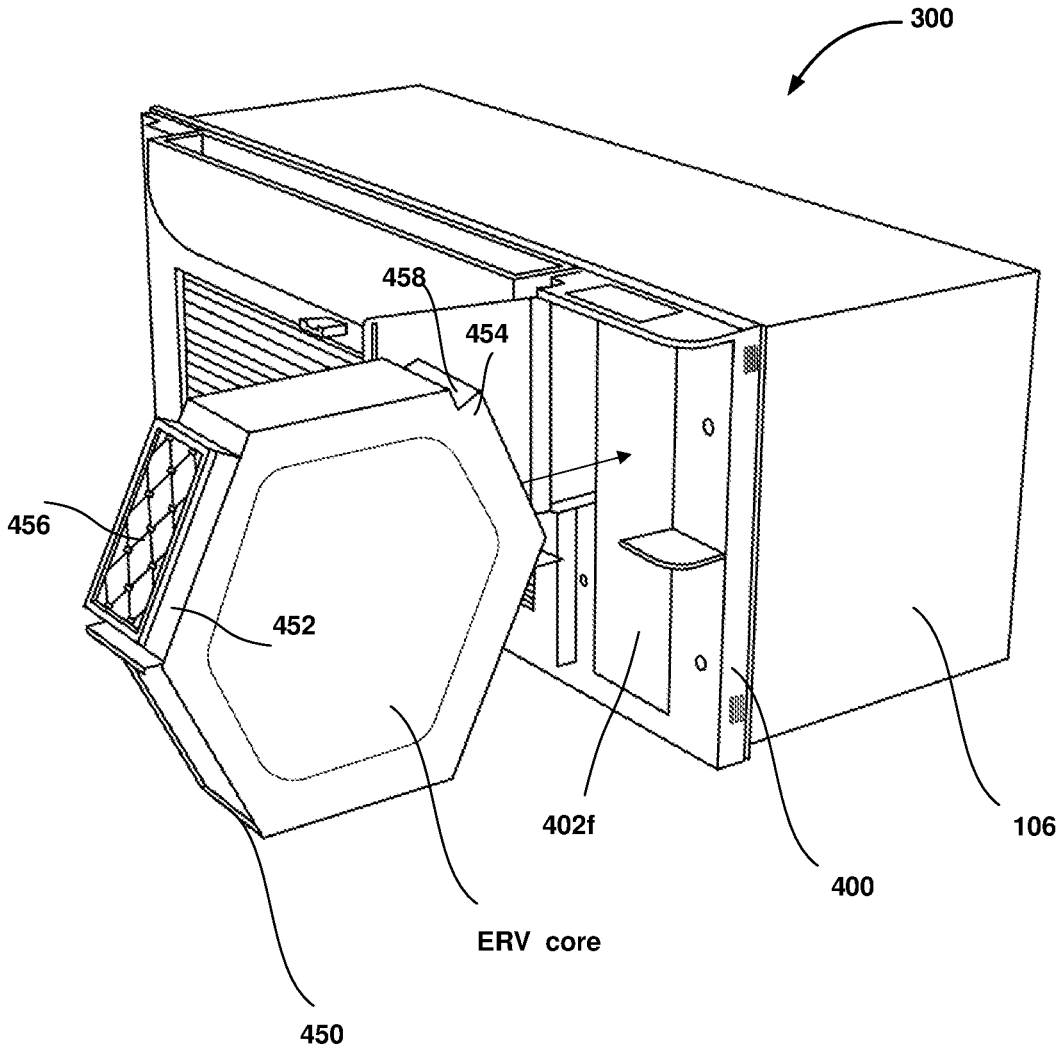
FIGS. 11A and 11B illustrate a filter housing or a bracket that surrounds the ERV core and is configured to receive the filters therein.
Figure 11B:
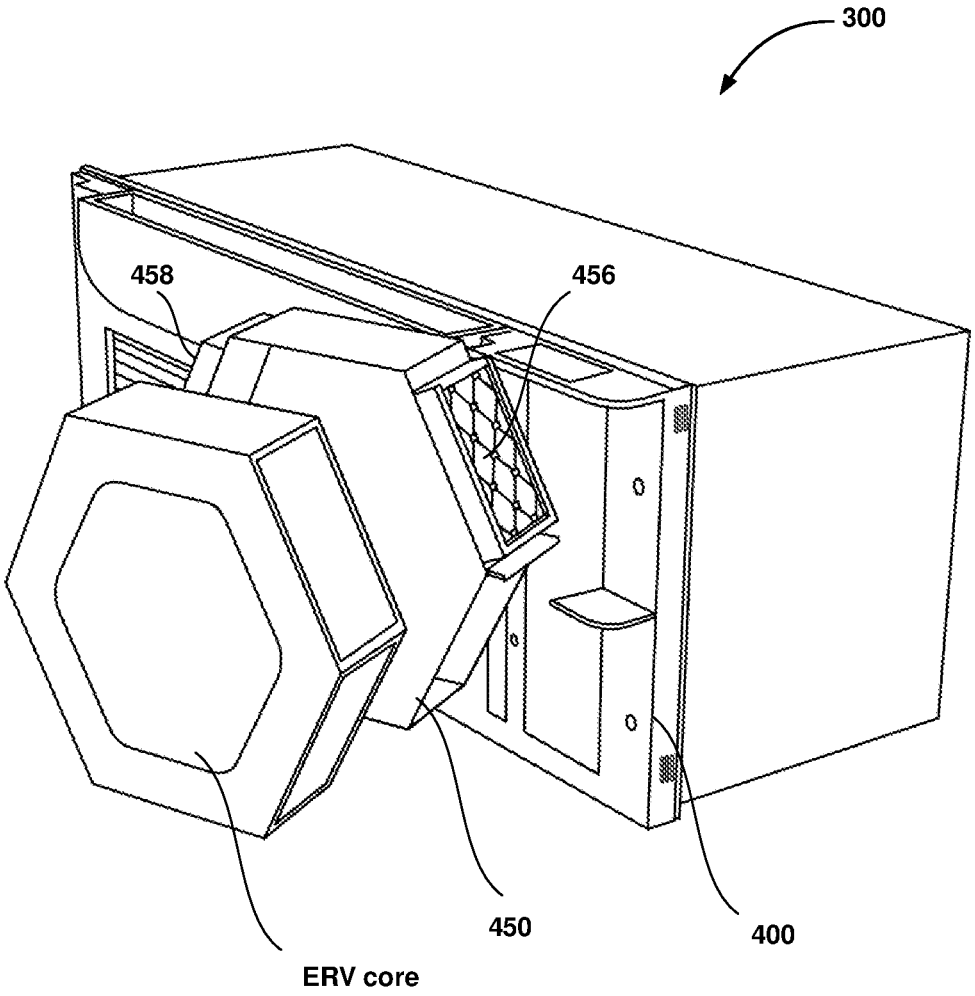

The inventor herein has envisioned strategic integration of an ERV or HRV unit as can be seen in FIGS. 11A, 11B within the housing/sleeve 106 of the PTAC 100 such as to decrease the work done by the heat pump/compressor and/or decrease the overall power consumption by the PTAC which would otherwise be much more. Further, the inventor herein provides an air sealing frame 400 configurable within the sleeve 106 of the PTAC system 100 to completely seal off the air leakage or infiltration from the sidewalls of the sleeve 106, provide sound insulation from the outdoor portion 104 to the indoor portion 102, and facilitate mounting of various indoor components within the sleeve 106 up to a certain or predefined depth of the sleeve (about 4 inches inward within the sleeve 106) thereby reducing the effective protruding length of the indoor portion 102 within the interior of the room. The configuration and the uses and benefits of the air sealing frame 400 will be described in detail in the description to follow. Besides this, the inventor herein proposes many other new changes related to the cover panel 109 of the PTAC system, filter housing, evaporation of the melt-water and so on which will be discussed in greater detail with respect to FIGS. 3-11.

Hereinafter the improved PTAC unit or PTAC system is referred to as 300. However, integration of the ERV or HRV unit within the traditional PTAC system 300 is a challenge in itself due to the unavailability of adequate space within the casing/sleeve 106 as seen in FIG. 1. In order to meet this requirement, the inventor herein proposes a new and improved configuration or placement for the outdoor heat exchanger 112, the outdoor fan 205, and the compressor unit 114, and associated flow lines of the outdoor portion 104 within the housing/sleeve 106. This reconfiguration of the outdoor heat exchanger 112, the outdoor fan 205, and the compressor unit 114 create additional space within the sleeve 106 for housing the ERV or HRV core which is shown and described by the inventor in detail in his US provisional Application No. 63/334,213, filed on Apr. 25, 2022, which is incorporated herein in its entirety.

Figure 9:
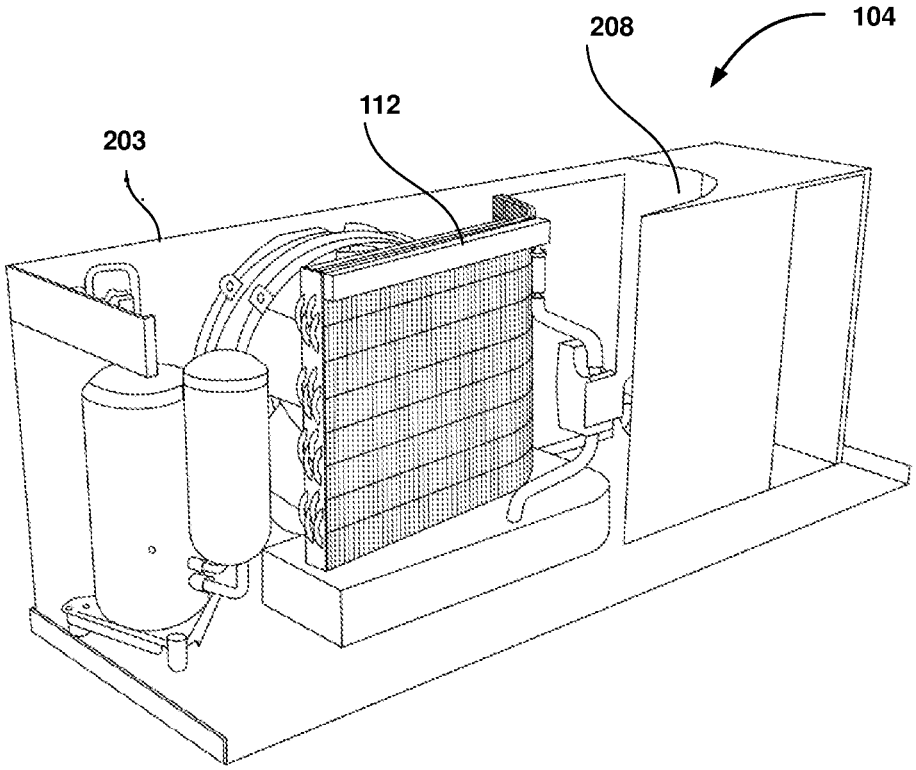
FIGS. 9 and 10 show a front perspective view and a back perspective view of the outdoor portion of the PTAC system, according to an exemplary embodiment of the present invention.

Inclusion of ERV or HRV unit, in accordance with an exemplary embodiment, fulfils additional air conditioning requirements to keep the room appropriately cool or heated as desired. The sleeve/housing 106 is further provided with a backplate 203 (FIGS. 9 and 10) connecting the sidewalls of the sleeve 106. The plate 203 has a cut-out section 204 for mounting the outdoor fan 205 thereon. The outdoor fan 205 is preferably an exhaust fan able to suck/draw air from the outdoor portion 104 and throw it outside. In contrast to the positioning of the outdoor fan in traditional PTAC unit 100, the outdoor fan 205 in the PTAC unit 300 is configured to get laid outside the external wall along the transverse direction T. The outdoor fan 205 is fitted along the cut-out section 204. Further, the backplate 203 includes an opening 206 for the outdoor fresh air to enter within the outdoor portion 104 (preferably in order to cool the compressor 114). Referring to FIGS. 9 and 10, the integrated ERV or HRV unit includes two inlet and two outlet ports (although only one inlet and one exhaust port are seen), the one of exhaust port 207 being oriented/positioned to redirect the exhausted air (cool or warm air) through a curvy route/channel 208 towards the outdoor coil 112 for increased power efficiency and reducing the work done by the compressor (114) alone. For example, during winter the warm air from the room will get into the unit and exhausted from this port 207 towards the coil 112 to efficiently increase the temperature of the air being pumped into the room by the PTAC while during the summer the process reverses. Additionally, the outdoor heat exchanger 112 instead of being placed parallel to the indoor heat exchanger 113 is configured at an angle or in a diagonal fashion as seen in FIG. 9 for the creation of the space to mount the ERV or HRV unit. For the purpose of this disclosure, it has been assumed that the functioning of the ERV/HRV unit is well known in the art, and the same has been also explained in the inventor's U.S. provisional application No. 63/334,213, filed Apr. 25, 2022, which is incorporated herein for reference. Thus, the functioning of the ERV unit is intentionally omitted herein.

Figure 3A:
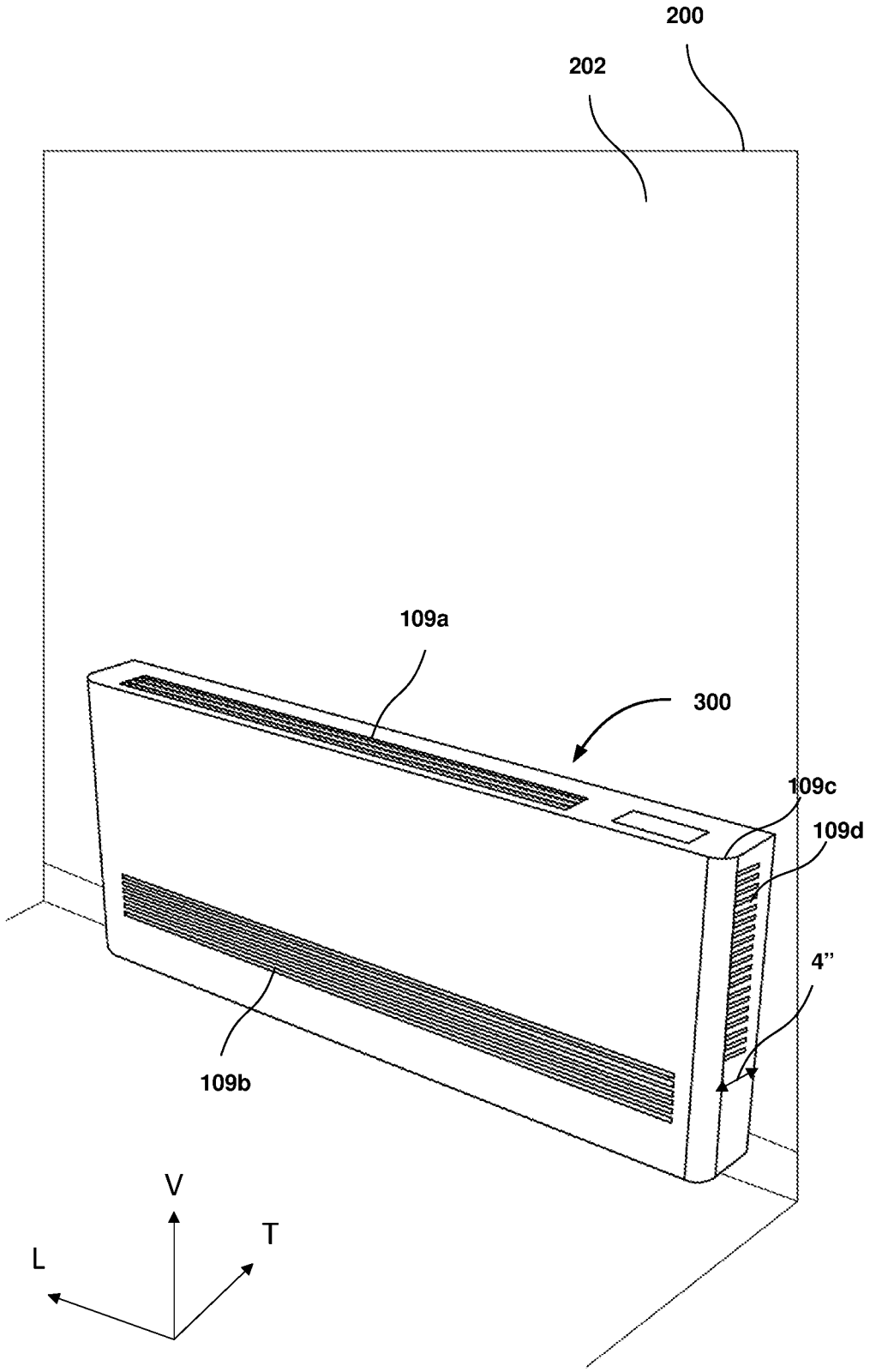
FIG. 3A-3B shows a PTAC system of the present invention installed on an external wall, according to one exemplary embodiment.
Figure 3B:
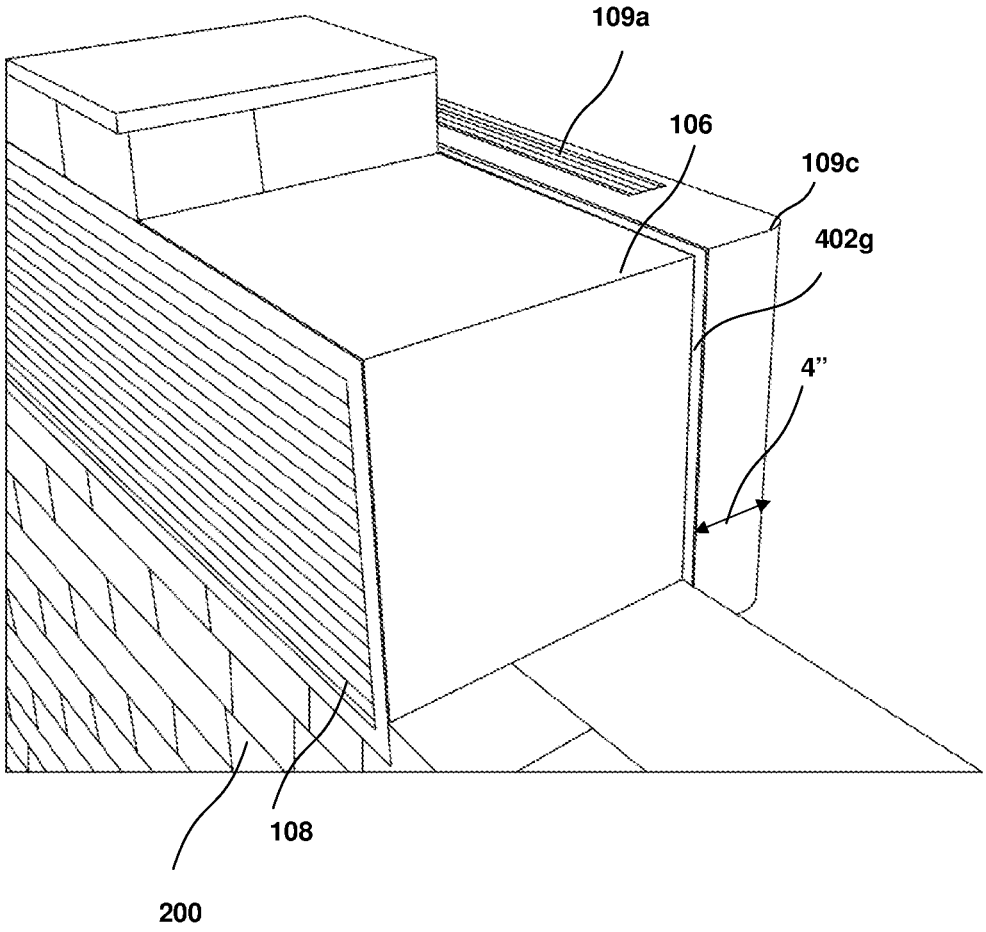
Figure 4:
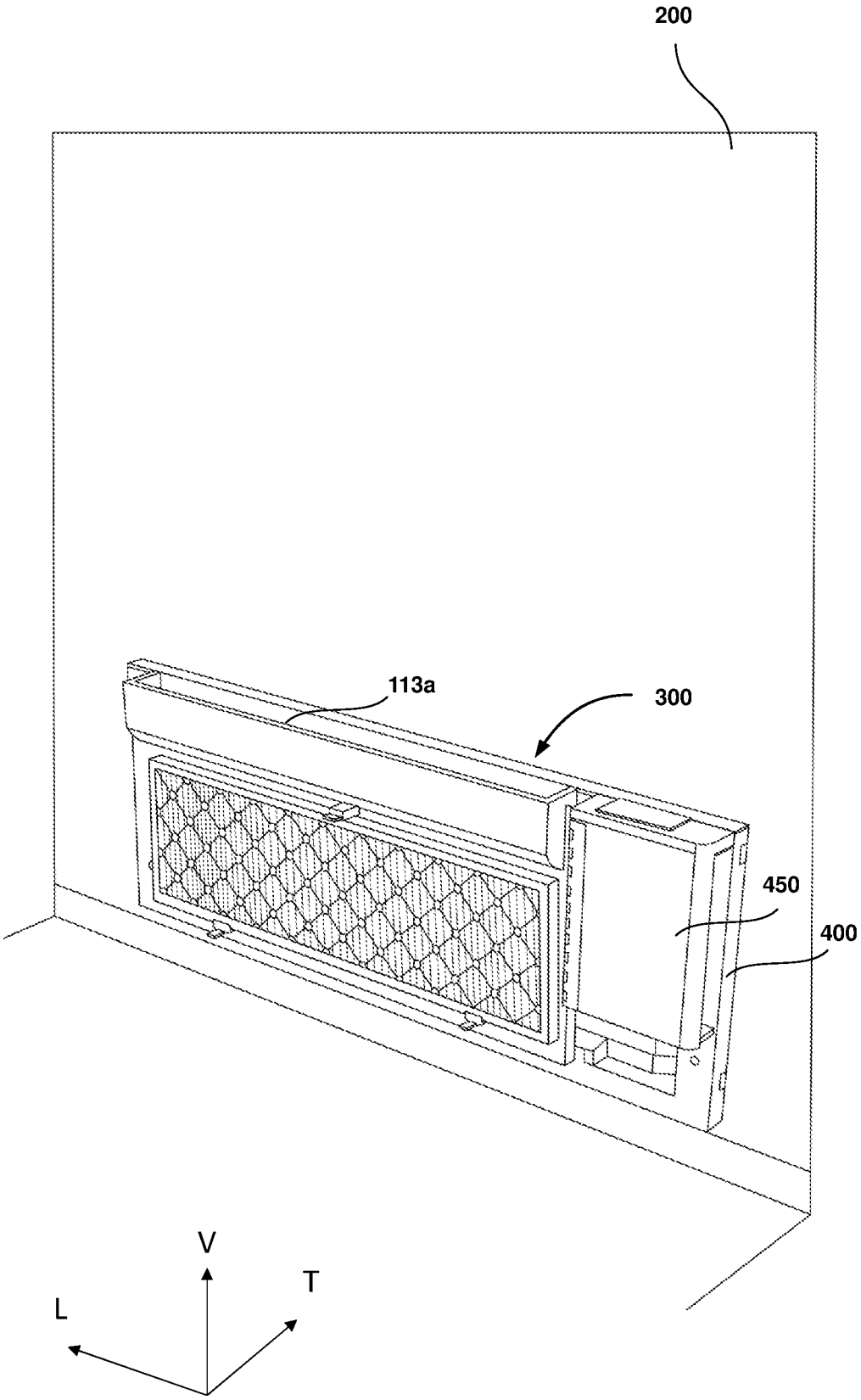
FIG. 4 shows the PTAC system of the present invention mounted on an external wall with a front panel cover removed.
Figure 5:
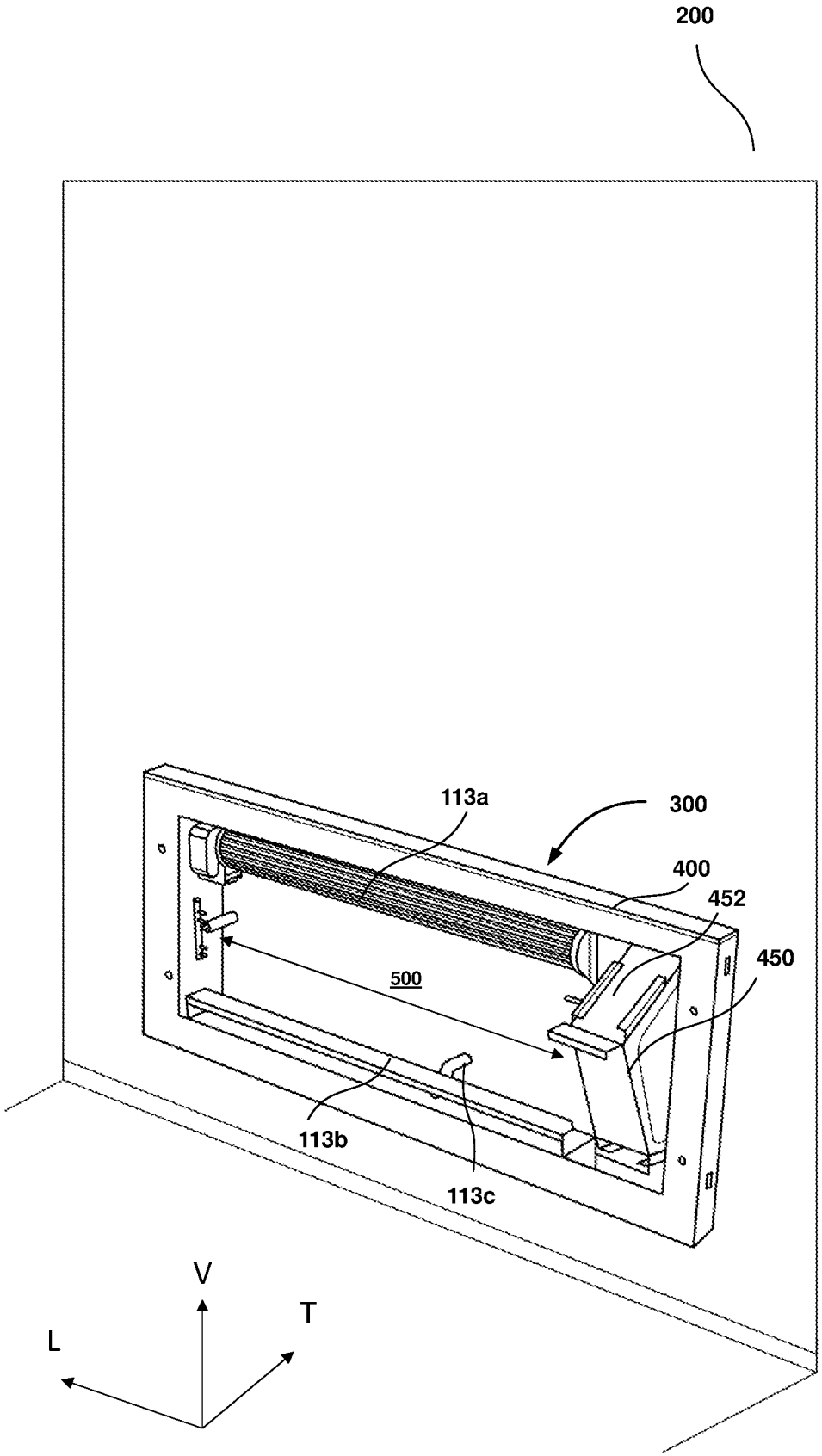
FIG. 5 shows the PTAC system of the present invention mounted on an external wall with some of the indoor components removed.
Figure 6:
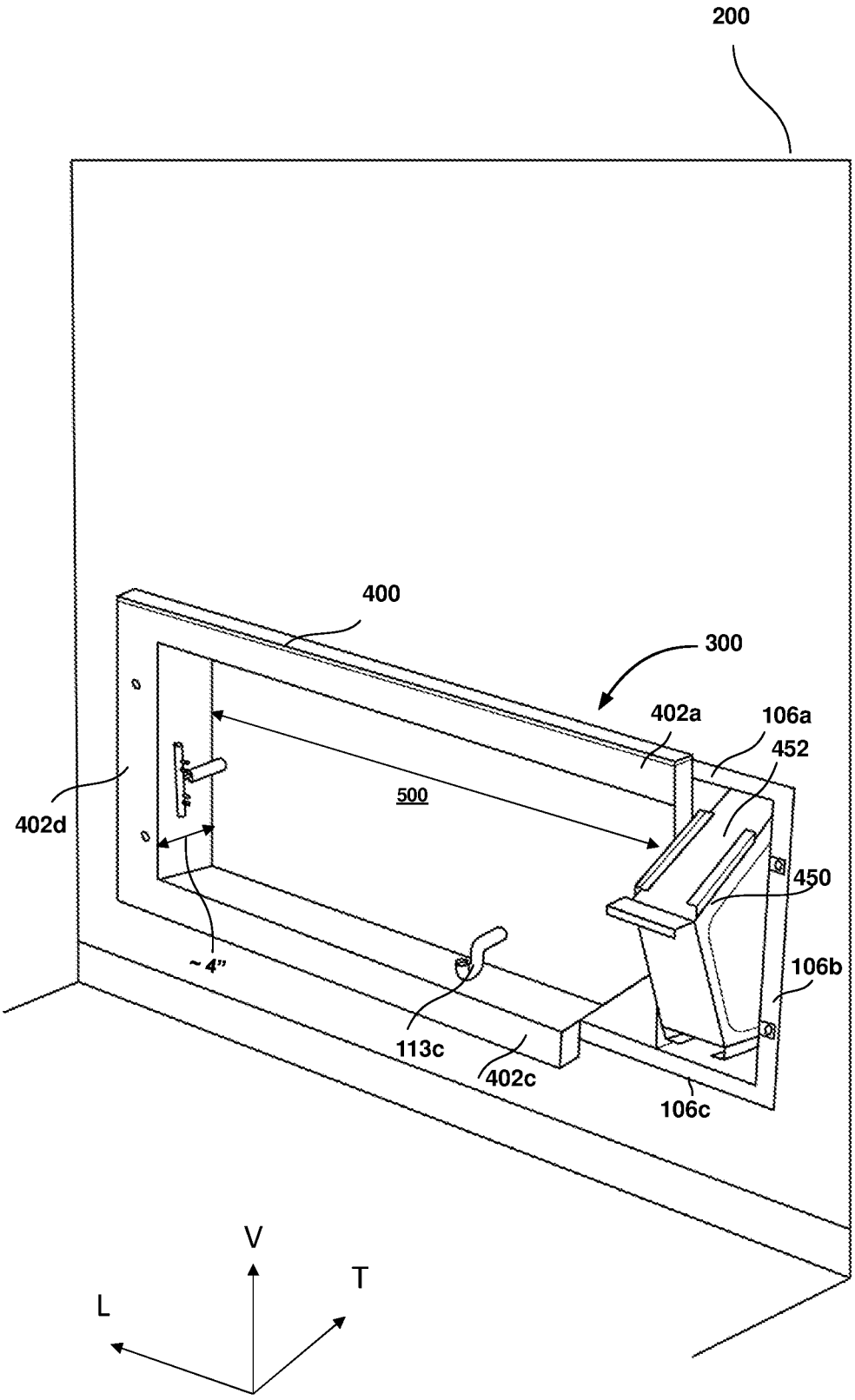
FIG. 6 shows the PTAC system of the present invention mounted on an external wall with all of the indoor components removed for the sake of showing an air sealing frame installed within the sleeve.

Referring to FIGS. 3A-3B, the proposed PTAC system 300 is shown configured on an external wall. The front panel cover 109 is designed to include a curvy design at its corner 109*c*. Further, the cover 109 includes side vents 109*d* besides the vents 109*a*, and 109*b* usually found in the traditional PTAC system 100 (as seen in FIG. 2A). The side vents 109*d* may be provided on one side or both sides of the cover panel 109. These additional vents 109*d* aid in quicker cooling and heating of the room. Additionally, as seen, the protruding length along the transverse direction T is effectively reduced to about half (E.g. 4 inches) due to the use of the air sealing frame 400 configurable within the sleeve 106 of the PTAC system 300.

Figure 7:
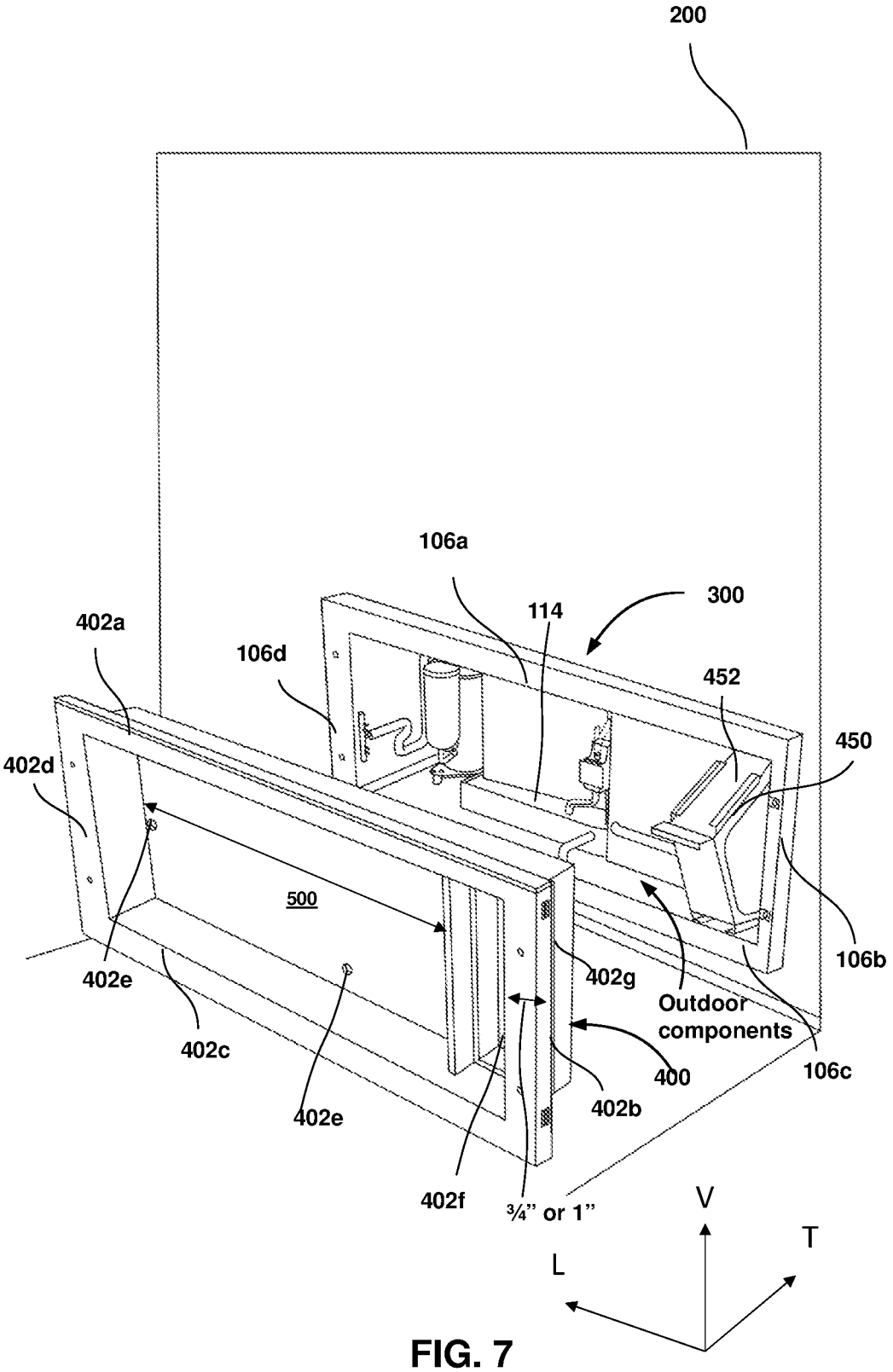
FIG. 7 shows the sleeve with outdoor components configured on an external wall and the air sealing frame separated from the sleeve.
Figure 8A:
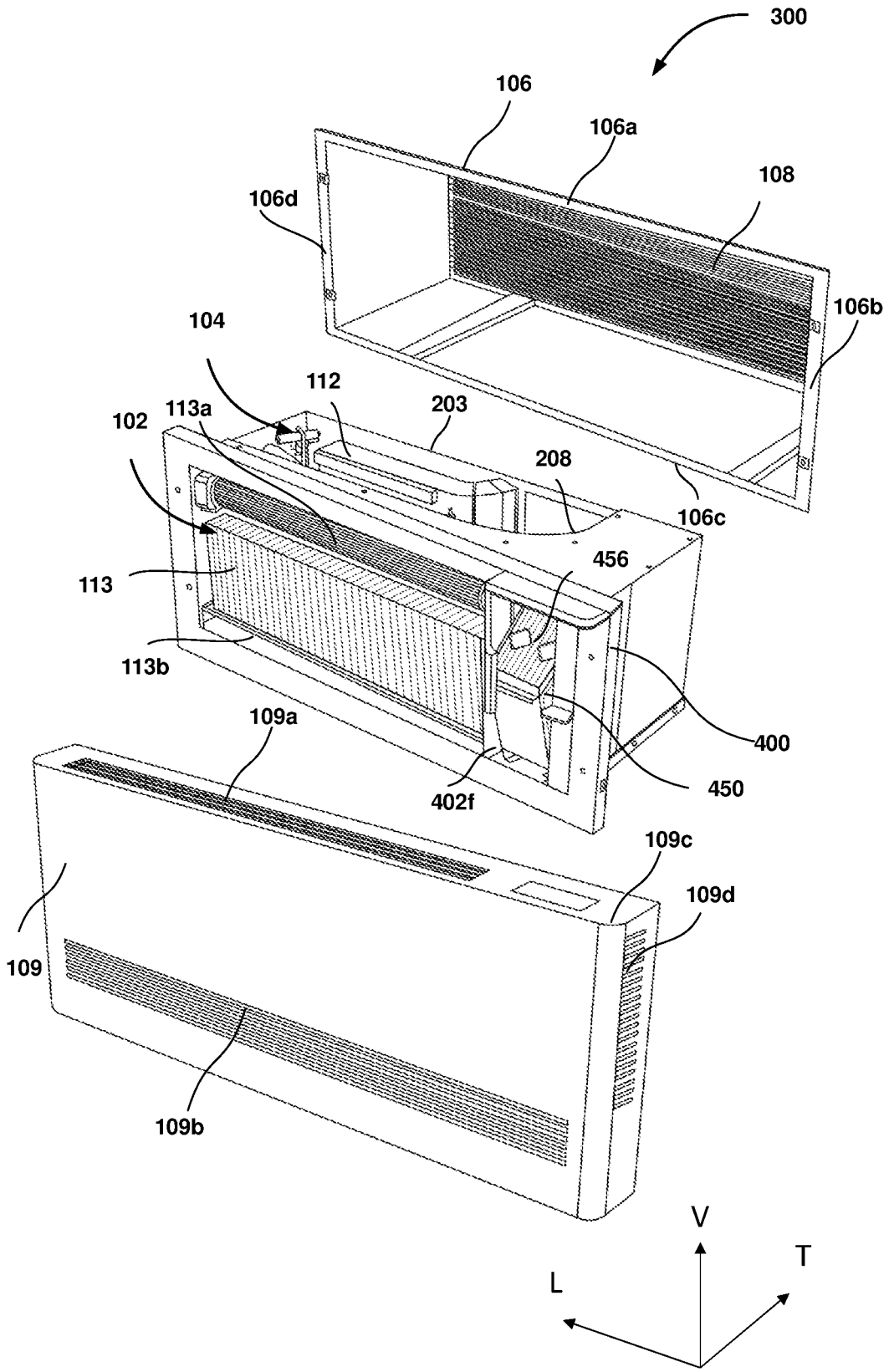
FIG. 8A shows the PTAC system of the present invention in an exploded view according to an exemplary embodiment.
Figure 8B:
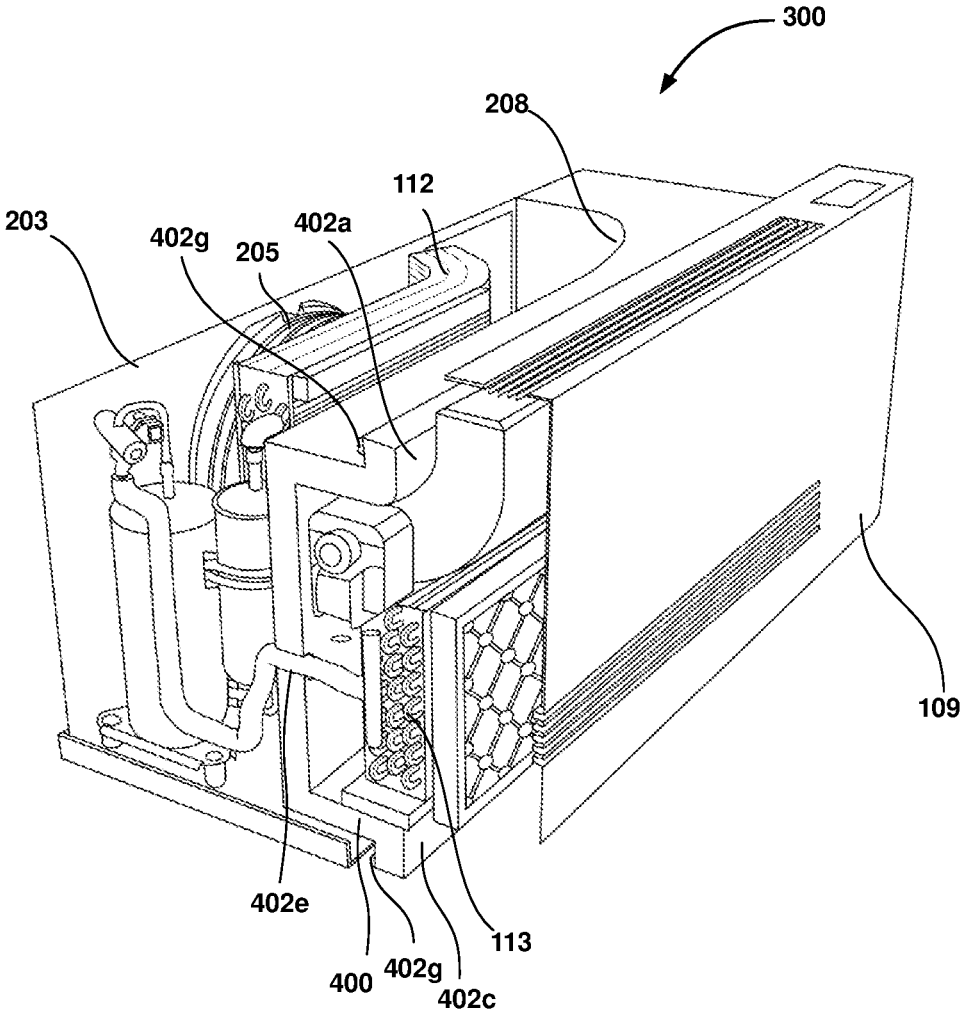
FIG. 8B shows a sectional side perspective view of the PTAC system of the present invention, according to an exemplary embodiment.

As seen in FIG. 3B and FIG. 7, the sleeve 106 with the rear grill 108 is configured on an external wall 200 such that the four sides 106*a*-106*d* of the sleeve 106 sit within the cut-out section on the wall 200. Ideally, all the four sides 106*a*-106*d* of sleeve 106 will contact the interior of the cut-out section but in practicality, there remains (or develop with time) some gap leading to air leakage from outdoor to indoor causing air infiltration. The outdoor components all sit within the sleeve 106 and are covered at the back by the rear grill 108. Thereafter, a box like air sealing frame 400 with four lips 402*a*-402*d* extending by a certain predetermined length say an inch or ¾ of an inch is pushed within the sleeve 106 having the outdoor components (such as a filter housing/bracket with ERV core 450, a compressor 114 etc). When pushed into the sleeve 106, the lips 402*a*-402*d* cover the infiltration gaps between the interior wall of the sleeve 106 and the separation wall 105 or the infiltration gap between the exterior of the sleeve 106 and the cut-out section on the wall 200. Ideally, the lips 402*a*-402*d* cover all the four sides 106*a*-106*d* of the sleeve 106 (shown in FIG. 3B, FIG. 5, and FIG. 6). The lips 402*a*-402*d* include a sealing gasket 402*g* made of rubber or similar resilient material at their back for effective sealing of the infiltration gap (FIG. 7 and FIG. 8B). Due to the presence of the insulating material at the back of the lips 402*a*-402*d*, the frame 400 ideally acts as a thick barrier. This thick barrier formed by the air sealing frame 400 helps in insulating the sound produced at the outdoor portion (for example by the compressor 114) thereby reducing the overall noise of the PTAC system 300. This thick insulation 402*g* formed at the back of the air sealing frame 400 thus prevents thermal bridge formation.

Now, referring to FIGS. 5-7, and 8A-8B, the air sealing frame 400 not only includes the lips 402*a*-402*d* but also has a recessed space 500 (with a certain length along direction T and a certain length along direction L). This recessed space 500 gets configured within the interior of the sleeve 106 when the frame 400 is installed or overlayed on the sleeve 106. This is essential and does offer space-saving because this recessed space 500 allows mounting of the indoor components such as indoor coil 113, an indoor fan 113*a*, and indoor tray 113*b* (on which the indoor coil 113 sits). Due to the feasibility of mounting the indoor components within the sleeve 106 to a certain length (equal to the length of the recessed space along direction T) within the space 500, the overall indoor portion length protruding within the interior of the room gets decreased. For example, if the length of the space 500 along direction T is 4 inches and the overall length of the interior portion is 8 inches then the design offers a reduction of the half of the length of the indoor portion protruding within the interior of the room. This increases the aesthetics of the room due to the smaller footprint of the PTAC unit being visible in the room.

The air sealing frame 400 includes one or more insulated holes 402*e* for wirings or flow lines from the indoor portion 102 to outdoor portion 104 or vice versa. The air sealing frame 400 further includes opening 402*f* (FIG. 7) configured for the filter housing/bracket 450 surrounding the ERV core to be accessible from the indoor portion 102. Referring to FIGS. 5-7, 8A-8B, and particularly to FIGS. 11A and 11B, the filter housing or bracket 450 includes strategically configured slots 452, 454 to hold air filters 456,458 therein. The bracket 450 sits on or surrounds the ERV core and then this assembly slides through the opening 402*f* of the frame 400 to get placed within the sleeve 106. The slots 452,454 and the filters 456,458 housed therein are configured in a slanted or angled orientation. The angularly laid out filters 456,458 help in the quick replacement and quick cleaning of the filters as and when required.

Further, as seen in FIGS. 5, 7, and 8A-8B, the PTAC system 300 is configured to include the tray 113*b* for the indoor coil 113 to sit thereon and collect melted water and pass on the collected water to a drain pan 114 provided in the outdoor portion 104. The tray 113*b* is oriented along the direction L within the space 500. The melted water from the tray 113*b* is passed to the drain pan 114 via P-Trap or a similar kind of water flow connection. Additionally, the drain pan 114 is configured to house one or more evaporating elements (heater) therein, in order to heat and evaporate any liquid collected in the drain pain 114. When the PTAC unit 300 or the outdoor and/or indoor coils 112,113 enters defrost mode, the melted water gets into the drain pan 114 which is then heated by a heater inside the pan 114 to evaporate the liquid. The heating elements auto-adjust the heat intensity depending upon the amount of liquid getting collected in the drain pan 114. In an example scenario, the heating element is linked to defrost cycle of the unit 300. Before the unit 300 enters the defrost mode, the heating element heats up and as soon as the liquid from the coils 112,113 arrives at the drain pan 114 is automatically evaporated due to the heat generated by the heating element.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the present invention.

What is claimed is:

1. A packaged terminal air conditioner (PTAC) system (300), comprising: a sleeve (106) embodying an indoor portion (102), and an outdoor portion (104), the outdoor portion (104) embodying outdoor components is separated from the indoor portion (102) embodying indoor components by an intermediate wall (105), wherein the sleeve (106) is provided with a backplate (203) connecting a plurality of sidewalls (106*a*-106*d*) of the sleeve (106) and wherein the backplate (203) comprises a cut-out section (204) for mounting an outdoor fan (205) thereon such that the outdoor fan 205 is laid outside an external wall along the transverse direction T, and an opening (206) for outdoor air to enter within the outdoor portion (104); an ERV or HRV unit accommodated in a space located within the sleeve (106) of the PTAC system (300) to decrease the work done by a compressor (114) of the outdoor portion (104) and/or decrease the overall power consumption by the PTAC system (300) and meet the air conditioning requirements of a living space and keep the living space appropriately cooled or heated; an air sealing frame (400) having a plurality of lips (402*a*-402*d*) extending a predetermined length and covering plurality of sidewalls (106*a*-106*d*) of the sleeve (106), the air sealing frame (400) is configurable within the sleeve (106) of the PTAC system (100) to cover infiltration gaps between interior walls of the sleeve (106) and the intermediate wall (105) separating indoor and outdoor portions (102,104) or the infiltration gaps between exterior of the sleeve (106) and the cut-out section on the external wall (200) where the sleeve (106) is mounted; wherein, the air sealing frame (400) facilitates mounting of various indoor components within the sleeve (106 up to a predefined depth of the sleeve (106), thereby reducing the effective protruding length of the indoor portion (102) within the interior of the living space; wherein, the lips (402*a*-402*d*) of the air sealing frame (400) further include a sealing gasket (402*q*) at their back for effective sealing of the infiltration gaps; and wherein, the ERV or HRV unit comprises two inlets and two exhaust ports, one of the exhaust ports (207) being positioned to redirect the exhausted air through a curvy route/channel (208) located within the outdoor portion (104) and toward an outdoor heat exchanger (112) of the outdoor portion (104) for increased power efficiency and reducing the work done by the compressor (114).

2. The PTAC system (300) of claim 1, wherein the outdoor portion (104) of the sleeve (106) comprising at least a rear grill (108), the outdoor fan (205), an outdoor heat exchanger (112), and the compressor (114) with associated flow lines all strategically located within the sleeve (106) to create a space to accommodate the ERV or HRV unit, and the indoor portion (102) comprising a front panel cover (109), wherein the rear grill (108) and the front panel cover (109) are disposed of in spaced-apart relation along a transverse direction T.

3. The PTAC system (300) of claim 1, wherein the outdoor fan (205) and the outdoor heat exchanger (112) are mounted in a spaced-apart relation along the transverse direction T, and the compressor (114) is housed towards a lateral direction L with respect to the outdoor fan (205).

4. The PTAC system (300) of claim 1, wherein the predefined depth of the sleeve (106) within which various indoor components are mounted is about 4 inches.

5. The PTAC system (300) of claim 2, wherein the front panel cover (109) has a curvy design along its corners (109*c*) and side vents (109*d*).

6. The PTAC system (300) of claim 5, wherein the side vents (109*d*) are provided on one side or both sides of the cover panel (109) to aid in quicker cooling and heating of the living space.

7. The PTAC system (300) of claim 1, wherein the sleeve (106) with the rear grill (108) and outdoor components is configured on the external wall (200) such that the plurality of sidewalls (106*a*-106*d*) of the sleeve (106) is laid within a cut-out section on the external wall (200) contacting the interior of the cut-out section.

8. The PTAC system (300) of claim 1, wherein the sealing gasket (402*g*) is made of insulating material for sealing the infiltration gaps and insulating the sound produced at the outdoor portion (104).

9. The PTAC system (300) of claim 1, wherein the air sealing frame (400) further comprises a recessed space (500) of a predefined length along the transverse direction T and a predefined length along the lateral direction L.

10. The PTAC system (300) of claim 9, wherein the recessed space (500) is configured within the interior of the sleeve (106) when the air sealing frame (400) is installed or overlayed on the sleeve (106).

11. The PTAC system (300) of claim 9, wherein this recessed space (500) allows mounting of the indoor components comprising the indoor coil (113), the indoor fan (113*a*), and an indoor tray (113*b*) within the sleeve (106) to a certain length equal to the length of the recessed space (500) along the transverse direction T reducing the overall length of the indoor portion (102) protruding within the interior of the living space.

12. The PTAC system (300) of claim 1, wherein the air sealing frame (400) further comprises one or more insulated holes (402*e*) for wirings or flow lines from the indoor portion (102) to the outdoor portion (104) or vice versa.

13. The PTAC system (300) of claim 1, wherein the air sealing frame (400) further comprises an opening (402*f*) configured for a filter housing (450) surrounding an ERV core to be accessible from the indoor portion (102).

14. The PTAC system (300) of claim 13, wherein the filter housing (450) comprises a plurality of slots (452,454) to hold a plurality of air filters (456,458) therein.

15. The PTAC system (300) of claim 13, wherein the filter housing (450) sits on or surrounds the ERV core and slides through the opening (402*f*) of the air sealing frame (400) to get placed within the sleeve (106).

16. The PTAC system (300) of claim 14, wherein the plurality of slots (452,454) and the plurality of air filters (456,458) housed therein are configured in a slanted or angled orientation to facilitate quick replacement and cleaning of the plurality of air filters (456,458) as and when required.

17. The PTAC system (300) of claim 11, wherein the indoor tray (113*b*) is adapted for the indoor coil (113) to sit thereon and collect melted water and pass on the collected water to a drain pan (114) provided in the outdoor portion (104).

18. The PTAC system (300) of claim 17, wherein the indoor tray (113*b*) is oriented along the lateral direction L within the recessed space (500).

19. The PTAC system (300) of claim 17, wherein the drain pan (114) comprises one or more evaporating elements in order to heat and evaporate any liquid collected in the drain pan (114) and wherein the one or more evaporating elements are capable of auto-adjusting the heat intensity depending upon the amount of liquid collected in the drain pan (114).

20. The PTAC system (300) of claim 1, wherein the predetermined length that the plurality of lips (402*a*-402*d*) of the air sealing frame (400) extends an inch or ¾ of an inch.

* * * * *